US007432672B2

(12) United States Patent
Meddaugh et al.

(10) Patent No.: US 7,432,672 B2
(45) Date of Patent: Oct. 7, 2008

(54) VARIABLE RADIOFREQUENCY POWER SOURCE FOR AN ACCELERATOR GUIDE

(75) Inventors: Gard Edson Meddaugh, Mountain View, CA (US); Raymond Denzil McIntyre, Los Altos Hills, CA (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 250 days.

(21) Appl. No.: 11/400,759

(22) Filed: Apr. 7, 2006

(65) Prior Publication Data

US 2007/0236300 A1 Oct. 11, 2007

(51) Int. Cl.
*H05H 9/00* (2006.01)
*H01J 23/00* (2006.01)

(52) U.S. Cl. ..... 315/505; 315/500

(58) Field of Classification Search ..... 315/138, 315/139, 140, 111.61, 500–501, 505, 506; 333/117, 120–121, 24 R, 24.1
See application file for complete search history.

(56) References Cited

U.S. PATENT DOCUMENTS 3,714,592 A * 1/1973 Jory ..... 315/5.13
3,820,035 A * 6/1974 Meddaugh ..... 315/5.13
3,868,602 A * 2/1975 Meddaugh ..... 333/17.1
3,969,693 A * 7/1976 Carter et al. ..... 333/258
4,710,733 A * 12/1987 Crill et al. ..... 332/144
6,067,448 A * 5/2000 Ho et al. ..... 455/78
6,111,503 A * 8/2000 Javitt et al. ..... 340/552
6,518,706 B1 * 2/2003 Yugami et al. ..... 315/111.81

* cited by examiner

*Primary Examiner*—Minh Dieu A
(74) *Attorney, Agent, or Firm*—Vista IP Law Group LLP

(57) ABSTRACT

An apparatus for use with an accelerator includes a circulator having a first port, a second port, a third port, and a fourth port, wherein the first port is configured to couple to a power generator, and the third port is configured to couple to an accelerator, a first phase shifter coupled to the second port, and a second phase shifter coupled to the fourth port. A method of regulating power to and from an accelerator includes providing power using a power generator, varying a magnitude of the power before the power is delivered to the accelerator, receiving a reflected power from the accelerator, and varying the phase of the reflected power from the accelerator. A method of regulating reflected power from an accelerator includes receiving a reflected power from an accelerator, varying the phase of the reflected power, and varying a magnitude of the reflected power.

38 Claims, 2 Drawing Sheets

VARIABLE RADIOFREQUENCY POWER SOURCE FOR AN ACCELERATOR GUIDE

FIELD

This invention relates generally to power sources, and more specifically, to a radiofrequency (RF) power source and its related components for use with electron beam accelerators.

BACKGROUND

Radiofrequency (RF) powered electron beam accelerators (or accelerator guides) have found wide usage in medical accelerators where the high energy electron beam is employed either directly for therapeutic purposes, or converted to generate x-rays for therapeutic and diagnostic purposes. The electron beam generated by an electron beam accelerator can also be used directly or indirectly to kill infectious pests, to sterilize objects, and to change physical properties of objects and materials. A further common use of electron beam accelerators is to perform radiographic testing and inspection of objects, such as containers for storing radioactive material, and concrete and steel structures.

The RF power for an electron beam accelerator is generally desired to be controlled, such that the beam energy from the accelerator can be delivered in a desired manner. It is common practice that the RF power be delivered to the accelerator as a series of short pulses, resulting in an electron beam output of a corresponding series of beam pulses. In some applications, it may be desirable that the accelerator be capable of generating beam energy pulses that vary between different energy levels, even on a pulse-by-pulse basis. However, existing systems may not be able to accomplish these objectives. Also, existing RF systems may not be able to control generated power such that power delivered to the accelerator can be varied quickly, e.g., in the order of milliseconds, between at least two power levels, which may be desirable in certain accelerator system applications.

Further, in existing systems, RF power provided by a power generator to an accelerator may be reflected back to the power generator. In many applications, it is desirable that such reflected RF power from the accelerator be controlled such that the frequency of a power generator will be "pulled" to the accelerator frequency, resulting in a stable operation of the power generator and the accelerator. If the reflected power is not controlled, the frequency of the power generator may be forced or "pulled" away from the operational frequency of the accelerator, resulting in failure of the accelerator to operate correctly.

SUMMARY

In accordance with some embodiments, an apparatus for use with an accelerator includes a circulator having a first port, a second port, a third port, and a fourth port, wherein the first port is configured to couple to a power generator, and the third port is configured to couple to an accelerator, a first phase shifter coupled to the second port, and a second phase shifter coupled to the fourth port.

In accordance with other embodiments, an apparatus for use with an accelerator includes a circulator having a first port, a second port, a third port, and a fourth port, wherein the first port is configured to couple to a power generator, and the third port is configured to couple to an accelerator, a first phase shifter coupled to the fourth port, a tee coupled to the first phase shifter, and a second phase shifter coupled to the tee.

In accordance with other embodiments, a method of regulating radiofrequency power to and from an accelerator includes providing power using a power generator, varying a magnitude of the power before the power is delivered to the accelerator, receiving a reflected power from the accelerator, and varying the phase of the reflected power from the accelerator.

In accordance with other embodiments, a method of regulating reflected power from an accelerator includes receiving a reflected power from an accelerator, varying the phase of the reflected power, and varying a magnitude of the reflected power. In some embodiments, by controlling the magnitude and phase of the reflected power back to the generator, the generator may be caused to operate with stability and at the correct operational frequency for the accelerator.

Other and further aspects and features will be evident from reading the following detailed description of the embodiments, which are intended to illustrate, not limit, the invention.

BRIEF DESCRIPTION OF THE DRAWINGS

The drawings illustrate the design and utility of preferred embodiments, in which similar elements are referred to by common reference numerals. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DESCRIPTION OF THE EMBODIMENTS

Figure 1:
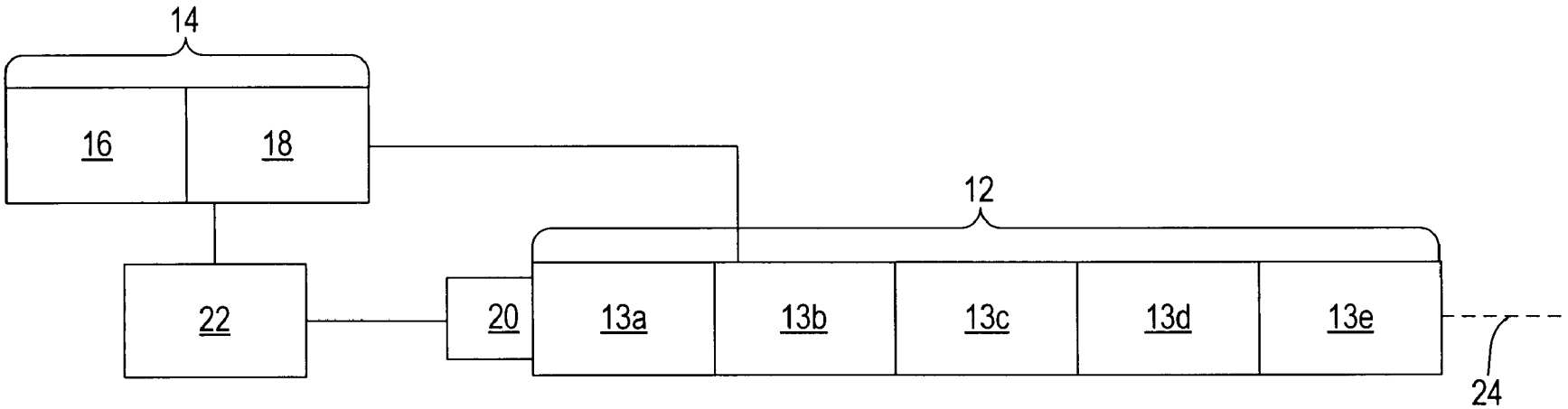
FIG. 1 is a block diagram of a radiation system having an electron accelerator that is coupled to a power source in accordance with some embodiments.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 is a block diagram of a radiation system 10 having an electron accelerator 12 that is coupled to a power system 14, which includes a power generator 16 and a power regulator 18 in accordance with some embodiments. The accelerator 12 includes a plurality of axially aligned cavities 13 (electromagnetically coupled resonant cavities). In the figure, five radiofrequency cavities 13*a*-13*e* are shown. However, in other embodiments, the accelerator 12 can include other number of cavities 13. The radiation system 10 also includes a particle source 20 for injecting particles such as electrons into the accelerator 12. During use, the accelerator 12 is excited by a power, e.g., microwave power, delivered by the power system 14 at a frequency, for example, between 1000 MHz and 20 GHz, and more typically, between 2800 and 3000 MHz.

The power generator 16 can be a Magnetron, or a Klystron, both of which are known in the art, or the like. In other embodiments, the power generator 16 can have other configurations. The power delivered by the power system 14 may be in a form of electromagnetic waves. The electrons generated by the particle source 20 are accelerated through the accelerator 12 by oscillations of the electromagnetic waves within the cavities 13 of the accelerator 12, thereby resulting in an electron beam 24. As shown in the figure, the radiation system 10 may further include a computer or processor 22, which controls an operation of the particle source 20 and/or the power system 14.

Figure 2:
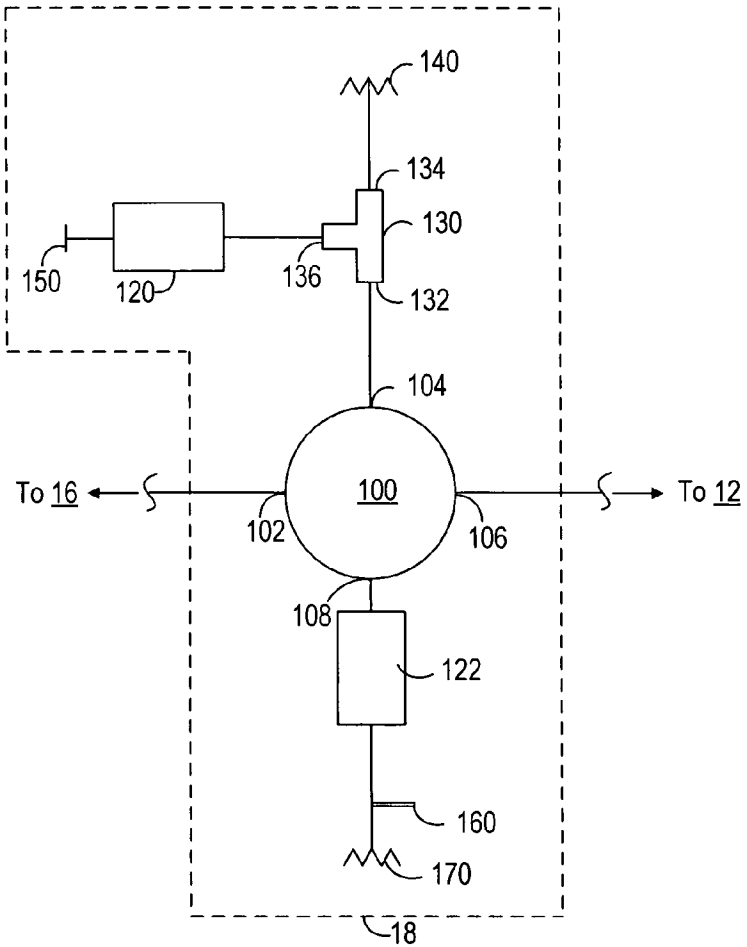
FIG. 2 illustrates a block diagram of a power regulator in accordance with some embodiments.

FIG. 2 illustrates the power regulator 18 of FIG. 1 in accordance with some embodiments. The RF power regulator 18 includes a circulator 100 having a first port 102, a second port 104, a third port 106, and a fourth port 108. The first port 102 is configured (e.g., sized and shaped) to couple to the power generator 16, and the third port 106 is configured to couple to the accelerator 12. The power regulator 18 also includes a first phase shifter 120 coupled to the second port 104, and a second phase shifter 122 coupled to the fourth port 108. Each of the first and the second phase shifters 120, 122 has a range of at least 180°. In other embodiments, the first and the second phase shifters 120, 122 can have other phase ranges. The circulator 100 can be any type of circulator known in the art, and may be implemented using a variety of known devices. Examples of circulator or its related components that may be used with embodiments described herein are available from Thales MESL in Scotland, UK, AFT Microwave GmbH in Germany, and The Ferrite Company in Nashua, N.H.

In the illustrated embodiments, the first phase shifter 120 is coupled to the second port 104 via a tee 130 having a first arm 132, a second arm 134, and a third arm 136, wherein the first arm 132 is coupled to the second port 104, the second arm 134 is coupled to a first load 140, and the third arm 136 is coupled to the first phase shifter 120. In some embodiments, the arms 132, 134, 136 may be tubular structures, the respective ends of which are sized and shaped to couple to the second port 104 (or to a coupling component, e.g., a tube, that is coupled between the second port 104 and the tee 130), the first load 140 (or to a coupling component, e.g., a tube, that is coupled between the first load 140 and the tee 130), and the first phase shifter 120 (or to a coupling component, e.g., a tube, that is coupled between the first phase shifter 120 and the tee 130), respectively.

The power regulator 18 also includes a short circuit 150 connected to the first phase shifter 120. In some embodiments, a mechanically-sliding short circuit may be used to replace devices 120,150, in which case, the short circuit may be used to adjust a phase shift. As shown in the figure, the power regulator 18 further includes a shunt reactance element 160 and a second load 170, both of which are coupled to the second phase shifter 122. The shunt reactance element 160 is sized to provide a proper magnitude of a signal to the generator 16. In some embodiments, the shunt reactance element 160 may be implemented by using a rod or a screw that penetrates a wall (e.g., a wall that is coupled to, or associated with, the second phase shifter 122). In other embodiments, the shunt reactance element 160 may be implemented by using other structure(s)/device(s) known in the art. For example, U.S. Pat. No. 3,714,592 discloses a shunt reactance element that may be used with embodiments described herein.

The phase shifter 120 can be implemented using a variety of devices known in the art. For example, in some embodiments, the phase shifter 120 can be a mechanical phase shifter, such as a ceramic element sized to be inserted into an electric field region. In other embodiments, the phase shifter 120 may be implemented electrically by using a fast ferrite tuner (FFT). The FFT is a transmission line partially filled with ferrite material, which is biased magnetically by an electromagnet. In such cases, phase control (e.g., microwave phase control) can be accomplished by changing a current to vary the magnetic field (being electromagnetically driven). Such configuration is advantageous in that it allows a relative phase be adjusted quickly, e.g., by changing the current level, and therefore the magnetic level and the corresponding RF phase-shift, within a few milliseconds, for example within an RF inter-pulse period. For example, in some embodiments, the current may be changed at every 10 milliseconds or less, and more typically, at every 2 milliseconds. In some cases, the above configuration allows adjacent RF pulses or pulse trains to be of different amplitudes. In further embodiments, the first phase shifter 120 can be implemented as other forms of a delay line. The phase shifter 120 can also be implemented using other mechanical and/or electrical components known in the art in other embodiments. Examples of phase shifter or its related components that may be used with embodiments described herein are available from Thales MESL in Scotland, UK, AFT Microwave GmbH in Germany, and The Ferrite Company in Nashua, N.H. In any of the embodiments described herein, the phase shifter 120 may be connected to a computer or a digital processor, which controls the operation of the phase shifter 120.

During use, the power generator 16 delivers power at a fixed level to the first port 102 of the circulator 100, and the power is transmitted from the first port 102 to the second port 104. At the second port 104, the power exits the circulator 100 and enters an radiofrequency circuit comprised of the first phase shifter 120, the short circuit 150, the tee 130, and the first load 140. The combination of the short circuit 150 and the phase shifter 120 provides the function of shunting the load 140 with a reactance that can vary from zero (short circuit) to infinity (open circuit), or any value therebetween, thereby reflecting, all, some, or none of the power back into the second port 104.

The power reflected back to the second port 104 (which can vary from a small amount to substantially all the power exiting the second port 104, and is changed in phase with respect to the phase of the RF out of the power generator 16) is transmitted to the third port 106, and is used by the accelerator 12 to accelerate an electron beam (e.g., to a desired energy level). Some power will be reflected from the accelerator 12 and be transmitted to the third port 106 of the circulator 100, where it is diverted to the fourth port 108.

The reflected power exiting the fourth port 108 is transmitted through a radiofrequency circuit comprised of the second phase shifter 122, the shunt reactance element 160, and the second load 170. Some of the reflected power is absorbed in the second load 170. The remaining reflected power is reflected by the reactance element 160, passes through the second phase shifter 122 again, and enters the fourth port 108. The reflected power entering the fourth port 108 is diverted to the first port 102, and is the reflected power that the power generator 16 "sees."

As illustrated in the above embodiments, the first phase shifter 120 is configured to affect a magnitude of the power being delivered to the third port 106 (and therefore, to the accelerator 12), and to affect the relative phase of radiofrequency between the first and the third ports 102, 106. Also, the second phase shifter 122 is configured to affect the relative phase of reflected radiofrequency power between the first and the third ports 102, 106 so that the power generator 16 sees the reflected power (wave) in the phase which causes it to "lock" to the accelerator's frequency. As such, the power regulator 18 of FIG. 2 allows the power provided to the accelerator 12 be varied, and the phase of the signal reflected back to the power generator 16 be controlled. By controlling phase of the reflected wave, the match (impedance) seen by the generator 16 can be changed or optimized. In some cases, the power regulator 18 allows power delivered from the power generator 16 to a resonant load (e.g., the accelerator guide) to be varied over a large range, with the power generator 16 seeing an effectively constant load during use. In some embodiments, the first radiofrequency circuit extending from the second port 104 is configured such that the power provided to the accelerator 12 may vary between two energy levels within an inter-pulse time period, such as at an interval that is between 2 milliseconds and 20 milliseconds. In other embodiments, the power provided to the accelerator 12 may vary at other time intervals.

Figure 3:
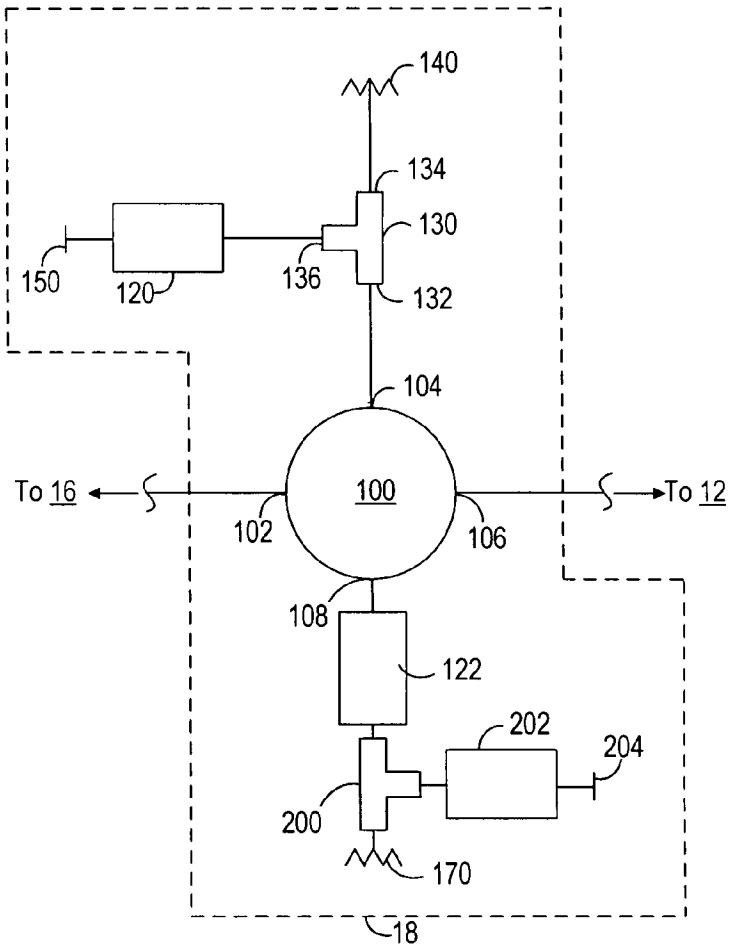
FIG. 3 illustrates a block diagram of a power regulator in accordance with other embodiments.

FIG. 3 illustrates the power regulator 18 of FIG. 1 in accordance with alternative embodiments. The power regulator 18 is similar to that described with reference to FIG. 1, with the exception that the reactance element 160 is replaced with a second tee 200, a third phase shifter 202, and a short circuit 204. The short circuit 204 may be a fixed short circuit. Alternatively, a mechanically-sliding short circuit may be used to replace devices 202, 204, in which case, the short circuit may be used to adjust a phase shift. The operation of the power regulator 18 is similar to that described with reference to FIG. 1. However, in the embodiments of FIG. 3, in addition to controlling the phase of power reflected to the power generator 16, the power regulator 18 is also capable of controlling the magnitude of power reflected to the power generator 16. In particular, the third phase shifter 202, together with the short circuit 204, is configured to affect the magnitude of the reflected power that the power generator 16 "sees" during use. In the illustrated embodiments, the second phase shifter 122 is configured to further adjust the phase of the reflected power that exits from the tee 200. By controlling phase and magnitude of the reflected wave, the match (impedance) seen by the generator 16 can be changed or optimized. Also, the embodiments of FIG. 3 is advantageous in that the regulator 18 provides independent control of the power (amplitude and phase) from the generator 16 to the accelerator 12, and the reflected power (amplitude and phase) from the accelerator 12 to the generator 16. In other embodiments, the power regulator 18 of FIG. 3 may not include the second phase shifter 122. The phase shifter 122 and/or the phase shifter 202 may have the same configuration as that of the phase shifter 120 in some embodiments.

The first radiofrequency circuit extending from the first port 104 and/or the second radiofrequency circuit extending from the fourth port 108 may have other configurations in other embodiments. For example, in other embodiments, either (or both) of the first and the second radiofrequency circuits may be implemented using other forms of a phase-shift delay line.

It should be noted that the power regulator 18 is not limited to the example discussed previously, and that the power regulator 18 can have other configurations in other embodiments. For example, in other embodiments, the power regulator 18 needs not have all of the elements shown in FIG. 2 or FIG. 3. Also, in other embodiments, two or more of the elements shown in FIG. 2 or FIG. 3 may be combined, or implemented as a single component. In further embodiments, any of the phase shifters (e.g., phase shifter 120, 122, or 202) may further include a knob or any of other types of control for controlling an operation of the phase shifter, as is known in the art.

Although particular embodiments have been shown and described, it will be understood that they are not intended to limit the present inventions, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

What is claimed is:

1. An apparatus for use with an accelerator, comprising:

a circulator having a first port, a second port, a third port, and a fourth port, wherein the first port is configured to couple to a power generator, and the third port is configured to couple to an accelerator;

a first phase shifter coupled to the second port; and a second phase shifter coupled to the fourth port.

2. The apparatus of claim 1, further comprising a short circuit connected to the first phase shifter.

3. The apparatus of claim 2, wherein the short circuit comprises a fixed short circuit.

4. The apparatus of claim 1, wherein the first phase shifter is mechanically operated.

5. The apparatus of claim 1, wherein the first phase shifter is electromagnetically operated.

6. The apparatus of claim 1, wherein the first phase shifter provides phase control in response to a varying magnetic field.

7. The apparatus of claim 1, further comprising a tee having a first arm, a second arm, and a third arm, wherein the first arm of the tee is coupled to the second port of the circulator, and the third arm of the tee is coupled to the first phase shifter.

8. The apparatus of claim 7, wherein the second arm of the tee is coupled to a load.

9. The apparatus of claim 1, further comprising a shunt reactance element coupled to the second phase shifter.

10. The apparatus of claim 9, further comprising a load coupled to the second phase shifter.

11. The apparatus of claim 1, further comprising a tee having a first arm, a second arm, and a third arm, wherein the first arm is coupled to the second phase shifter, and the second arm is coupled to a load.

12. The apparatus of claim 11, further comprising a third phase shifter coupled to the third arm of the tee.

13. The apparatus of claim 12, further comprising a short circuit coupled to the third phase shifter.

14. The apparatus of claim 13, wherein the short circuit comprises a fixed short circuit.

15. The apparatus of claim 1, further comprising the power generator.

16. The apparatus of claim 15, wherein the power generator comprises a standing wave power generator.

17. The apparatus of claim 15, wherein the power generator comprises a magnetron.

18. The apparatus of claim 1, wherein the first phase shifter is configured for adjusting a relative phase of radiofrequency power between the first and the third ports.

19. The apparatus of claim 1, wherein power delivered to the third port varies between a first power level and a second power level.

20. An apparatus for use with an accelerator, comprising:

a circulator having a first port, a second port, a third port, and a fourth port, wherein the first port is configured to couple to a power generator, and the third port is configured to couple to an accelerator;

a first phase shifter coupled to the fourth port;

a tee coupled to the first phase shifter; and a second phase shifter coupled to the tee.

21. The apparatus of claim 20, wherein the tee comprises a first arm, a second arm, and a third arm, the first phase shifter is coupled to the first arm of the tee, and the second phase shifter is coupled to the third arm of the tee.

22. The apparatus of claim 21, further comprising a load coupled to the second arm of the tee.

23. The apparatus of claim 22, further comprising a short circuit coupled to the second phase shifter.

24. The apparatus of claim 20, wherein the second phase shifter is electromagnetically operated.

25. The apparatus of claim 20, wherein the fourth port is along a path in which a reflected power is delivered from the third port to the first port.

26. The apparatus of claim 20, wherein the second port is along a path in which a generated power is delivered from the first port to the third port.

27. A method of regulating radiofrequency power to and from an accelerator, comprising:

providing power using a power generator;

varying a magnitude of the power before the power is delivered to the accelerator;

receiving a reflected power from the accelerator; and varying the phase of the reflected power from the accelerator.

28. The method of claim 27, further comprising varying a magnitude of the reflected power.

29. The method of claim 27, wherein the magnitude of the power is varied at a time interval that is a value between 2 milliseconds to 20 milliseconds.

30. The method of claim 27, wherein the reflected power is received at the generator.

31. The method of claim 27, wherein the act of varying the phase of the reflected power from the accelerator comprises changing a relative phase of radiofrequency between the accelerator and the power generator.

32. A method of regulating reflected power from an accelerator, comprising:

receiving a reflected power from an accelerator;

varying the phase of the reflected power; and varying a magnitude of the reflected power.

33. The method of claim 32, wherein the phase is varied using a first phase shifter.

34. The method of claim 33, wherein the magnitude is varied using a second phase shifter and a load.

35. The method of claim 32, further comprising delivering the reflected power to a power generator after the phase and magnitude are varied.

36. The method of claim 35, wherein the power generator comprises a standing wave power generator.

37. The method of claim 32, wherein the reflected power is received at a power generator.

38. The method of claim 32, wherein the act of varying the phase of the reflected power comprises changing a relative phase of radiofrequency between the accelerator and a power generator.

* * * * *